US008956187B2

(12) United States Patent
He et al.

(10) Patent No.: US 8,956,187 B2
(45) Date of Patent: Feb. 17, 2015

(54) ELECTRICAL CONNECTOR

(71) Applicant: Cheng Uei Precision Industry Co., Ltd., New Taipei (TW)

(72) Inventors: Feng-Bin He, Dong-Guan (CN); Zhu-Rui Liu, Dong-Guan (CN)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 118 days.

(21) Appl. No.: 13/865,986

(22) Filed: Apr. 18, 2013

(65) Prior Publication Data

US 2014/0315446 A1 Oct. 23, 2014

(51) Int. Cl.
*H01R 13/648* (2006.01)
*H01R 13/504* (2006.01)

(52) U.S. Cl.
CPC ..... *H01R 13/504* (2013.01)
USPC ..... 439/607.35

(58) Field of Classification Search
USPC ..... 439/607.35–607.4
See application file for complete search history.

(56) References Cited

U.S. PATENT DOCUMENTS 8,215,997 B2 * 7/2012 Hsia ..... 439/660
8,388,380 B1 * 3/2013 Van der Steen ..... 439/607.36
8,454,388 B2 * 6/2013 Song ..... 439/607.36
8,550,847 B2 * 10/2013 Hsia ..... 439/607.11
8,574,001 B2 * 11/2013 Lee ..... 439/490
8,764,484 B2 * 7/2014 Zhang et al. ..... 439/607.36
8,821,189 B2 * 9/2014 Wang et al. ..... 439/620.21
8,827,742 B2 * 9/2014 Wang ..... 439/569
2008/0045084 A1 * 2/2008 Chang ..... 439/607
2008/0096429 A1 * 4/2008 Mikolajczak et al. ... 439/620.08
2009/0036000 A1 * 2/2009 Cheng et al. ..... 439/752.5
2009/0098746 A1 * 4/2009 Chiu et al. ..... 439/76.1
2009/0142946 A1 * 6/2009 Lu ..... 439/95
2011/0195606 A1 * 8/2011 Hsia ..... 439/660
2011/0281463 A1 * 11/2011 Ahn et al. ..... 439/607.01
2011/0312200 A1 * 12/2011 Wang et al. ..... 439/218
2011/0312218 A1 * 12/2011 Song ..... 439/607.36
2011/0312223 A1 * 12/2011 Wang et al. ..... 439/626
2012/0190228 A1 * 7/2012 Lee ..... 439/271
2012/0231673 A1 * 9/2012 Hayashi et al. ..... 439/675
2012/0252255 A1 * 10/2012 Colantuono et al. ..... 439/353
2012/0252281 A1 * 10/2012 Hsia ..... 439/660
2013/0137309 A1 * 5/2013 Lin ..... 439/660
2013/0164982 A1 * 6/2013 Zhang et al. ..... 439/607.46
2013/0183844 A1 * 7/2013 Wang ..... 439/271
2013/0260617 A1 * 10/2013 Wang et al. ..... 439/682
2013/0273784 A1 * 10/2013 Little et al. ..... 439/660
2014/0024259 A1 * 1/2014 Kelsch et al. ..... 439/620.01
2014/0065889 A1 * 3/2014 Zhang et al. ..... 439/660

(Continued)

*Primary Examiner* — Ross Gushi
(74) *Attorney, Agent, or Firm* — Cheng-Ju Chiang

(57) ABSTRACT

An electrical connector includes an insulating body, a plurality of terminals integrated in the insulating body, a strengthening structure and a shell mounted around the insulating body. The insulating body has a base portion and a tongue portion extending forward from a front face of the base portion. A top face of the tongue portion is concaved downward to form a receiving groove passing through a front end of the tongue portion. The strengthening structure has a base plate and two holding arms which oppositely extend from two opposite side edges of a rear of the base plate. A front edge of the base plate is bent downward to form a protecting eave. The base plate is molded in the receiving groove of the tongue portion and the holding arms are embedded in the base portion. The front end of the tongue portion is wrapped by the protecting eave.

6 Claims, 3 Drawing Sheets

(56) References Cited

U.S. PATENT DOCUMENTS

| | | | | |
|---|---|---|---|---|
| 2014/0073184 | A1* | 3/2014 | Zhao et al. | 439/607.55 |
| 2014/0073190 | A1* | 3/2014 | Zhao et al. | 439/626 |
| 2014/0099832 | A1* | 4/2014 | Chang | 439/660 |
| 2014/0099835 | A1* | 4/2014 | Chang | 439/682 |
| 2014/0113497 | A1* | 4/2014 | Wang | 439/660 |
| 2014/0113498 | A1* | 4/2014 | Sasaki et al. | 439/676 |
| 2014/0162484 | A1* | 6/2014 | Naito et al. | 439/345 |
| 2014/0187094 | A1* | 7/2014 | Zhao et al. | 439/626 |
| 2014/0187105 | A1* | 7/2014 | Zhao et al. | 439/733.1 |
| 2014/0287625 | A1* | 9/2014 | Chan | 439/607.01 |
| 2014/0287628 | A1* | 9/2014 | Zhang et al. | 439/626 |

* cited by examiner

ELECTRICAL CONNECTOR

BACKGROUND OF THE INVENTION

1. Field of the Invention

The present invention relates to an electrical connector, and more particularly to an electrical connector having a strengthening structure.

2. The Related Art

With the development of electronic technology, electrical connectors are widely used to transmit data between electronic devices. A conventional electrical connector generally includes an insulating body, a plurality of terminals disposed in the insulating body, and a shell mounted around the insulating body. The insulating body has a base portion and a tongue portion extending forward from the base portion. In use, the electrical connector is often mated with a mating connector to realize data transmission between the electrical connector and the mating connector. However, the tongue portion of the insulating body made of plastic material is easily broken or abraded in the process of frequent insertion and extraction of the electrical connector and the mating connector, so that often influences the performance of the electrical connector and even may make the electrical connector be declared worthless. Therefore, an electrical connector capable of overcoming the foregoing problems is required.

SUMMARY OF THE INVENTION

It is an object of the present invention to provide an electrical connector. The electrical connector includes an insulating body, a plurality of terminals integrated in the insulating body, a strengthening structure and a shell mounted around the insulating body. The insulating body has a base portion and a tongue portion extending forward from a front face of the base portion. A top face of the tongue portion is concaved downward to form a receiving groove passing through a front end of the tongue portion. The strengthening structure has a base plate and a pair of holding arms which oppositely extend from two opposite side edges of a rear of the base plate. A front edge of the base plate is bent downward to form a protecting eave. The base plate is molded in the receiving groove of the tongue portion of the insulating body and the holding arms are embedded in the base portion. The front end of the tongue portion is wrapped by the protecting eave.

As described above, the electrical connector of the present invention utilizes the strengthening structure molded in the insulating body to effectively reduce the force acted on the tongue portion so as to protect the tongue portion from being broken in the process of frequent insertion and extraction of the electrical connector and an external mating connector. Furthermore, the front end of the tongue portion is wrapped by the protecting eave of the strengthening structure, so that can further protect the tongue portion of the insulating body from being abraded in the process of the electrical connector being mated with the mating connector, and prolong the useful life of the electrical connector.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 2:
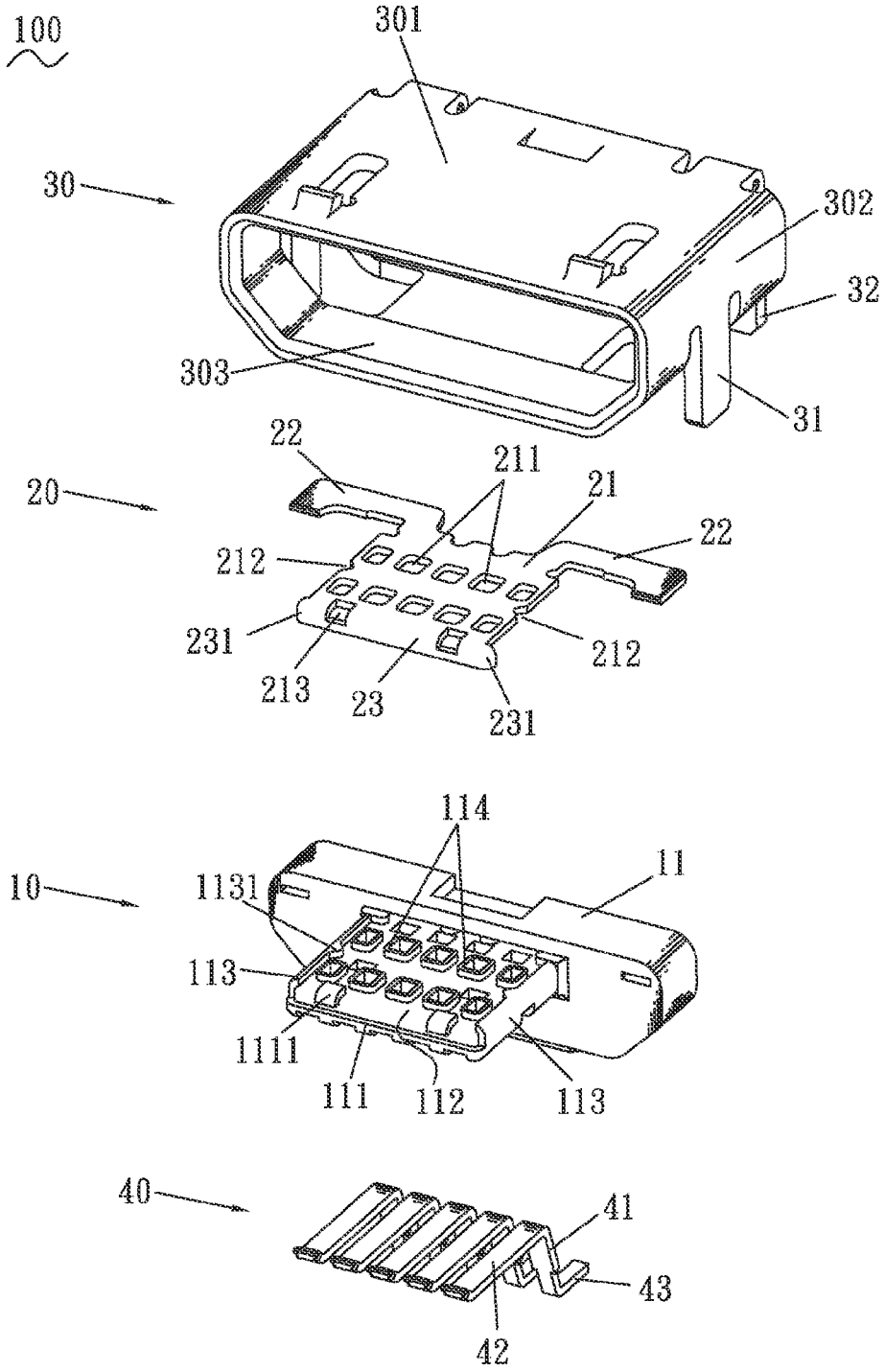
FIG. 2 is an exploded perspective view of the electrical connector of FIG. 1.

Referring to FIG. 2, an electrical connector 100 according to an embodiment of the present invention includes an insulating body 10, a strengthening structure 20, a plurality of terminals 40 and a shell 30.

Referring to FIG. 2 again, the insulating body 10 has a base portion 11 of which a front face extends forward to form a tongue portion 111. A plurality of through holes (not labeled) is vertically opened in the tongue portion 111. A top face of the tongue portion 111 is concaved downward to form a substantially rectangular receiving groove 112 passing through a front end of the tongue portion 111. Accordingly, a pair of side walls 113 is formed at two sides of the receiving groove 112, and substantial middles thereof protrude inward to form a pair of fixing blocks 1131. A bottom side of the receiving groove 112 protrudes upward to form a plurality of ring-shaped buckling frames 114 encircling the through holes respectively. A front end of the bottom side of the receiving groove 112 protrudes upward and then is bent rearward to from two buckling portions 1111.

Figure 1:
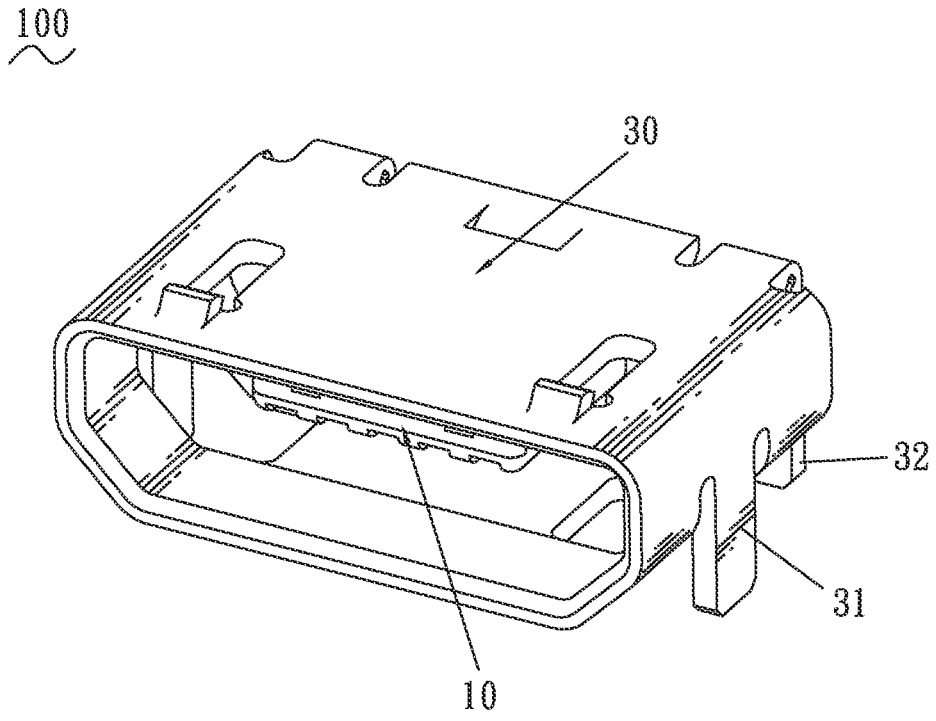
FIG. 1 is an assembled perspective view of an electrical connector in accordance with an embodiment of the present invention.
Figure 3:
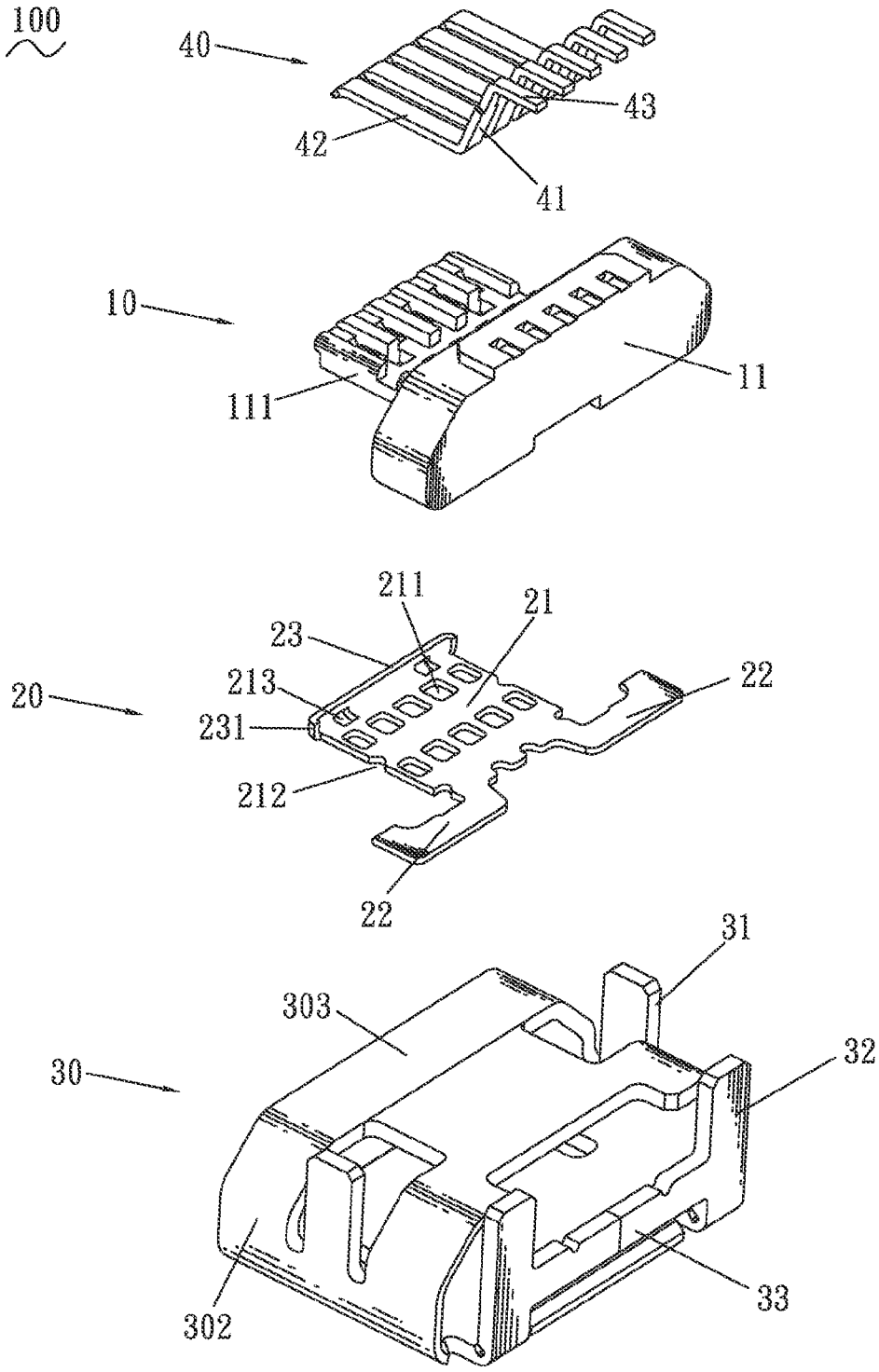
FIG. 3 is an exploded perspective view of the electrical connector of FIG. 1 viewed from another angle.

Referring to FIG. 1, FIG. 2 and FIG. 3, each of the terminals 40 has a fixing strip 41, a contact strip 42 and a soldering tail 43 oppositely extending from two ends of the fixing strip 41. The terminals 40 are integrated in the insulating body 10 at regular intervals. In detail, the fixing strip 41 is molded in the base portion 11, the contact trip 42 is molded in the tongue portion 111 and exposed outside, and the soldering tail 43 stretches outside from a bottom of the base portion 11.

Referring to FIG. 2 and FIG. 3, the strengthening structure 20 is substantially a T-shaped metal slice, and has a substantially rectangular base plate 21 and a pair of holding arms 22 which oppositely extend from two opposite side edges of a rear of the base plate 21. A front edge of the base plate 21 is bent downward to form a protecting eave 23 of which two opposite ends further protrude sideward to form a pair of protecting ears 231. A plurality of buckling holes 211 is apart opened in the base plate 21. Substantial middles of two opposite side edges of the base plate 21 are concaved inward to form a pair of fixing gaps 212. Two buckling apertures 213 are apart opened across the front edge of the base plate 21. The strengthening structure 20 is molded in the insulating body 10. In detail, the base plate 21 is molded in the receiving groove 112 of the tongue portion 111 and the holding arms 22 are embedded in the base portion 11. The buckling frames 114 are buckled in the buckling holes 211 respectively, and the fixing blocks 1131 are snapped in the corresponding fixing gaps 212. The front ends of the tongue portion 111 and the side walls 113 are wrapped by the protecting eave 23 and the protecting ears 231, and the buckling portions 1111 are buckled in the buckling apertures 213 respectively.

Referring to FIG. 1, FIG. 2 and FIG. 3 again, the shell 30 is mounted around the insulating body 10. The shell 30 has a top plate 301, two side plates 302 and a bottom plate 303 connected together. Bottom edges of the side plates 302 protrude downward to form two first fixing feet 31. Two ends of a rear edge of the top plate 301 are bent and extend downward to form two second fixing feet 32. Two face-to-face edges of the second fixing feet 32 extend towards each other to form a pair of blocking boards 33 which are blocked behind the insulating body 10.

As described above, the electrical connector 100 of the present invention utilizes the strengthening structure 20 molded in the insulating body 10 to effectively reduce the force acted on the tongue portion 111 so as to protect the tongue portion 111 from being broken in the process of frequent insertion and extraction of the electrical connector 100 and an external mating connector. Furthermore, the front ends of the tongue portion 111 and the side walls 113 are wrapped by the protecting eave 23 and the protecting ears 231 of the strengthening structure 20, so that can further protect the tongue portion 111 of the insulating body 10 from being abraded in the process of the electrical connector 100 being mated with the mating connector, and further prolong the useful life of the electrical connector 100.

What is claimed is:

1. An electrical connector, comprising:

an insulating body having a base portion and a tongue portion extending forward from a front face of the base portion, a top face of the tongue portion being concaved downward to form a receiving groove passing through a front end of the tongue portion;

a plurality of terminals integrated in the insulating body;

a strengthening structure having a base plate and a pair of holding arms which oppositely extend from two opposite side edges of a rear of the base plate, a front edge of the base plate being bent downward to form a protecting eave, the base plate being molded in the receiving groove of the tongue portion of the insulating body and the holding arms being embedded in the base portion, the front end of the tongue portion being wrapped by the protecting eave; and a shell being mounted around the insulating body.

2. The electrical connector as claimed in claim 1, wherein two opposite ends of the protecting eave of the strengthening structure further protrude sideward to form a pair of protecting ears, a pair of side walls is formed at two sides of the receiving groove of the insulating body, front ends of the side walls are wrapped by the protecting ears of the strengthening structure.

3. The electrical connector as claimed in claim 1, wherein a plurality of through holes is vertically opened in the tongue portion of the insulating body, a bottom side of the receiving groove protrudes upward to form a plurality of buckling frames encircling the through holes respectively, a plurality of buckling holes is apart opened in the base plate of the strengthening structure, the buckling frames are buckled in the buckling holes respectively.

4. The electrical connector as claimed in claim 3, wherein two opposite side edges of the base plate are concaved inward to form a pair of fixing gaps, a pair of side walls is formed at two sides of the receiving groove of the insulating body with a pair of fixing blocks protruding inward thereon, the fixing blocks are snapped in the corresponding fixing gaps.

5. The electrical connector as claimed in claim 3, wherein a front end of the bottom side of the receiving groove protrudes upward and then is bent rearward to from two buckling portions, two buckling apertures are apart opened across the front edge of the base plate, the buckling portions are buckled in the buckling apertures respectively.

6. The electrical connector as claimed in claim 1, wherein the shell has a top plate, two side plates and a bottom plate connected together, bottom edges of the side plates protrude downward to form two first fixing feet, two ends of a rear edge of the top plate are bent and extend downward to form two second fixing feet, two face-to-face edges of the second fixing feet extend towards each other to form a pair of blocking boards which are blocked behind the insulating body.

* * * * *